US009340038B2

(12) United States Patent
Yamasaki

(10) Patent No.: US 9,340,038 B2
(45) Date of Patent: May 17, 2016

(54) DRAWING APPARATUS AND METHOD FOR CONTROLLING DRAWING IN DRAWING APPARATUS

(71) Applicant: CASIO COMPUTER CO., LTD., Tokyo (JP)

(72) Inventor: Shuichi Yamasaki, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/745,975

(22) Filed: Jun. 22, 2015

(65) Prior Publication Data

US 2015/0375526 A1 Dec. 31, 2015

(30) Foreign Application Priority Data

Jun. 27, 2014 (JP) ..... 2014-132058

(51) Int. Cl.
*B41J 29/38* (2006.01)
*B41J 29/393* (2006.01)
*B41J 3/407* (2006.01)

(52) U.S. Cl.
CPC ..... *B41J 3/4073* (2013.01)

(58) Field of Classification Search
CPC ..... B41J 3/4073
USPC ..... 347/9, 19
See application file for complete search history.

(56) References Cited

U.S. PATENT DOCUMENTS 6,286,517 B1 * 9/2001 Weber ..... A45D 29/00 132/200
2013/0038647 A1 * 2/2013 Hashimoto ..... A45D 29/00 347/2

FOREIGN PATENT DOCUMENTS

JP 2003-534083 A 11/2003

OTHER PUBLICATIONS

English Abstract of WO 01/91598 A1, dated Dec. 6, 2001.

* cited by examiner

*Primary Examiner* — Jason Uhlenhake
(74) *Attorney, Agent, or Firm* — Scully, Scott, Murphy & Presser, P.C.

(57) ABSTRACT

A drawing apparatus detects, as base coat information, a contour of a base coat region which is formed on a surface of a drawing object by applying a first ink used for a base coat on the surface of the drawing object with a drawing tool so as to fill in a design region surrounded with a contour of a design image, before the design image is printed on the surface of the drawing object, and adjusts a size of the design image and generates an adjusted design image which has a size sufficient to cover a whole area of the base coat region, based on the detected base coat information.
The drawing apparatus then prints, by a print head, the adjusted design image on the base coat region at a position at which the adjusted design image covers the whole area of the base coat region.

15 Claims, 7 Drawing Sheets

DRAWING APPARATUS AND METHOD FOR CONTROLLING DRAWING IN DRAWING APPARATUS

CROSS-REFERENCE TO RELATED APPLICATIONS

This application is based upon and claims the benefit of priority from the prior Japanese Patent Application No. 2014-132058 filed on Jun. 27, 2014, the entire contents of which are incorporated herein by reference.

BACKGROUND OF THE INVENTION

1. Field of the Invention

The present invention relates to a drawing apparatus and a method for controlling drawing in the drawing apparatus.

2. Description of the Related Art

Heretofore, there has been known a drawing apparatus which includes print heads to execute printing by an inkjet system, and prints design images including colors and/or patterns on finger nails. Such a drawing apparatus is disclosed in, for example, Japanese Unexamined Patent Application Publication No. 2003-534083.

When such a drawing apparatus prints the design images on the nails by the inkjet system, ground colors of the nails can be seen through the printed design images because inks used in the print heads in the inkjet system have transparency. Because the nails have colors that is not white, color development of the inks used in the inkjet system is impaired under the influence of the ground colors of the nails, and thereby design characteristics are impaired.

SUMMARY OF THE INVENTION

The present invention has an advantage of providing a drawing apparatus and a method for controlling drawing in the drawing apparatus, by which color development of ink becomes satisfactory without being influenced by a color of a drawing object when a design image is printed on the drawing object, and accordingly design characteristics are prevented from being impaired.

According to one aspect of the present invention, there is provided a drawing apparatus including: a base coat information detecting section that detects, as base coat information, a contour of a base coat region which is formed on a surface of a drawing object by applying a first ink used for a base coat with a drawing tool so as to fill in a design region surrounded with a contour of a design image, before the design image is printed on the surface of the drawing object; a design adjusting section that adjusts a size of the design image and generates an adjusted design image which has a size sufficient to cover a whole area of the base coat region, based on the base coat information; and a print head that prints the adjusted design image on the base coat region so as to cover the whole area of the base coat region.

According to another aspect of the present invention, there is provided a method for controlling drawing in a drawing apparatus, the method including: detecting, as base coat information, a contour of a base coat region which is formed on a surface of a drawing object by applying a first ink used for a base coat with a drawing tool so as to fill in a design region surrounded with a contour of a design image, before the design image is printed on the surface of the drawing object; adjusting the design image and generating an adjusted design image which has a size sufficient to cover a whole area of the base coat region, based on the detected base coat information; and printing the adjusted design image on the base coat region so as to cover the whole area of the base coat region.

BRIEF DESCRIPTION OF THE SEVERAL VIEWS OF THE DRAWINGS

The above and further objects, features and advantages of the present invention will be made clearer by the following detailed description and the attached drawings, in which.

DETAILED DESCRIPTION OF THE PREFERRED EMBODIMENTS

Figure 1:
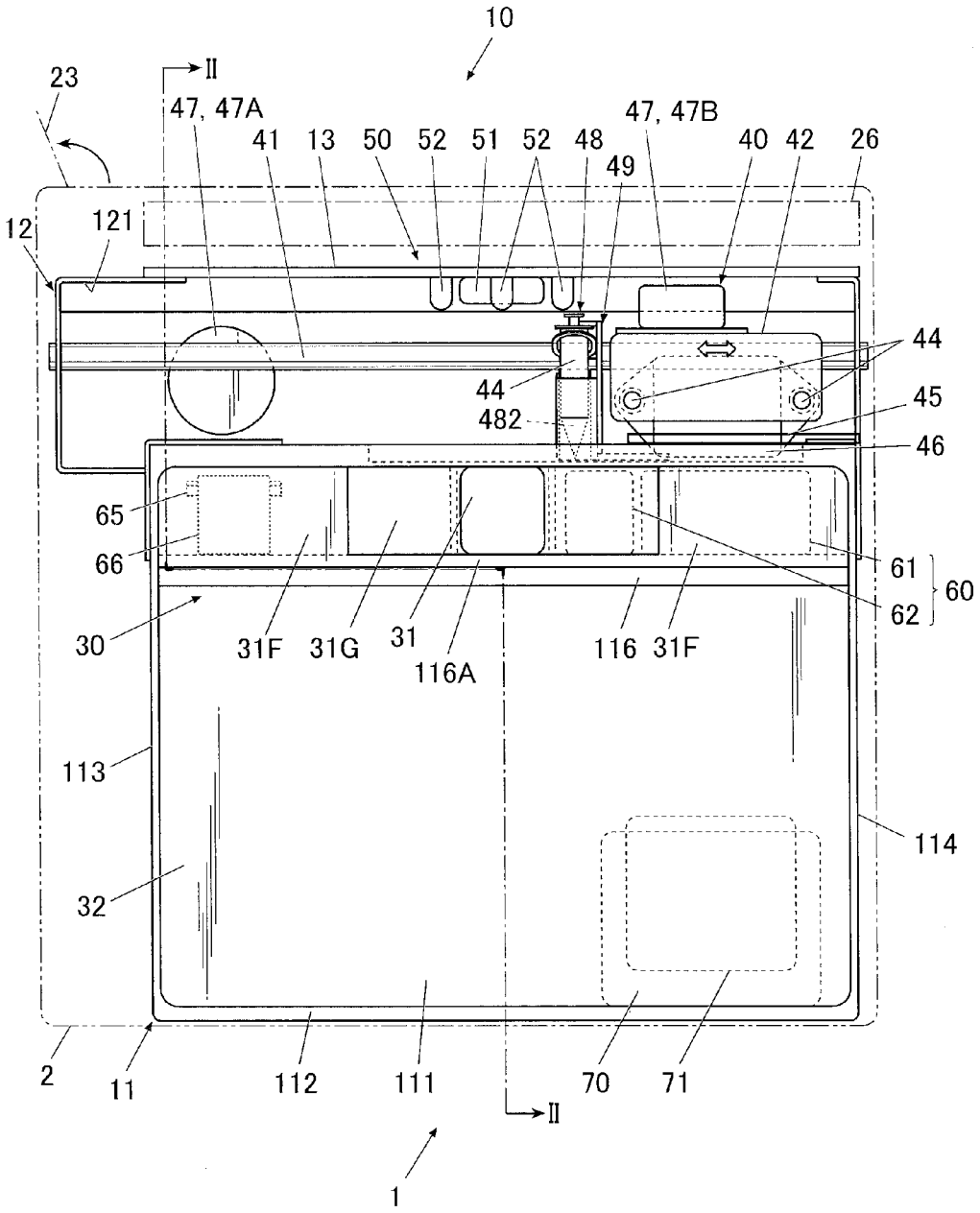
FIG. 1 is a front view of a drawing apparatus according to this embodiment.

Hereinafter an embodiment of a drawing apparatus of the present invention will be described in detail with reference to the drawings. In this regard, however, the scope of the present invention is not limited to the illustrated examples.

The following embodiment describes the case that the drawing apparatus performs drawing on surfaces of finger nails as surfaces of drawing objects. However, the surfaces of the drawing objects of the present invention are not limited to the surfaces of the finger nails. For example, surfaces of toe nails can be the surfaces of the drawing objects of the present invention.

FIG. 1 is a front view of a drawing apparatus according to this embodiment.

Figure 2:
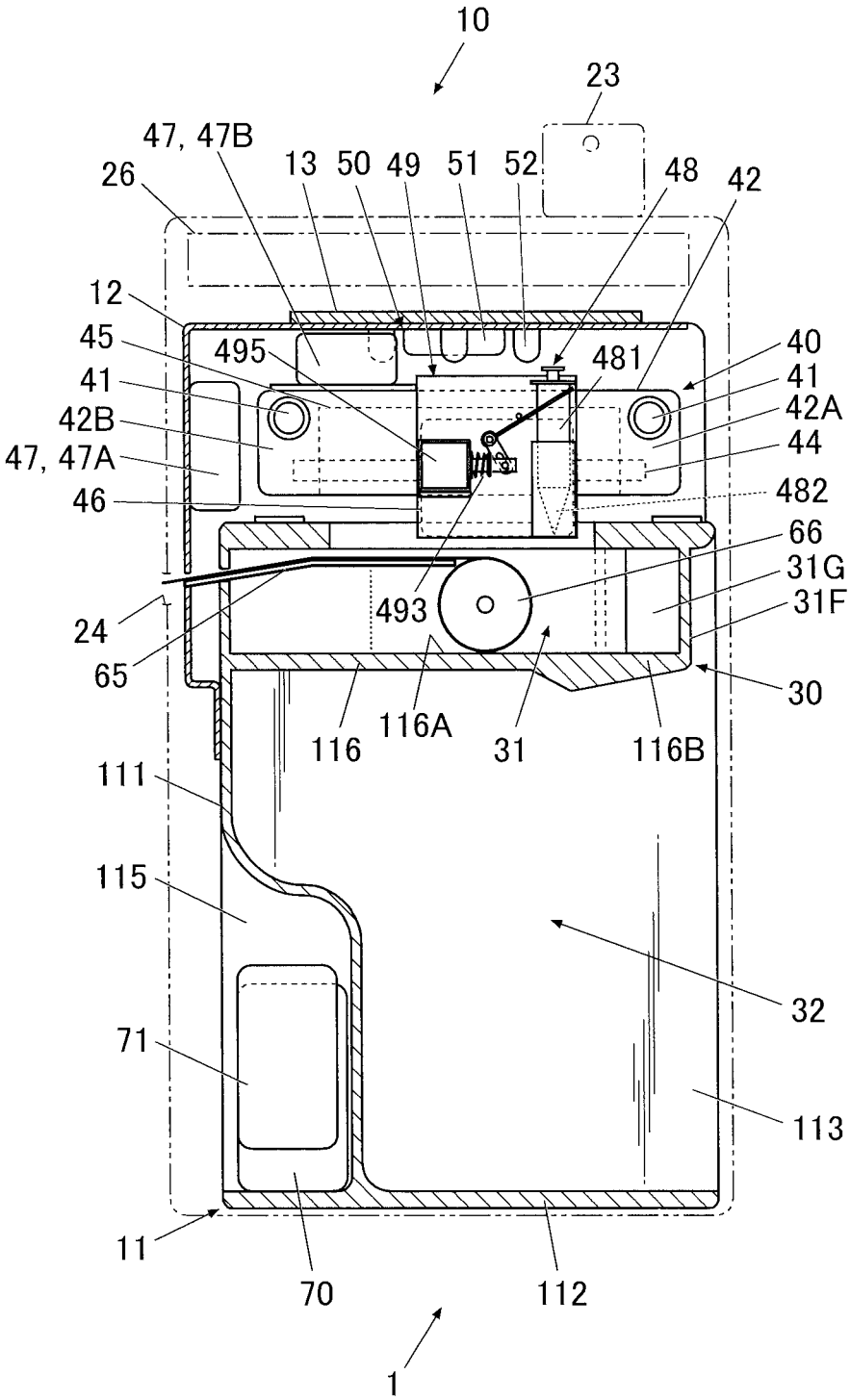
FIG. 2 is a cross-section view along line II-II viewed in the direction of arrows illustrated in FIG. 1.

FIG. 2 is a cross-section view along line II-II viewed in the direction of arrows illustrated in FIG. 1.

As illustrated in FIGS. 1 and 2, a drawing apparatus 1 is, for example, a nail printing apparatus, and includes a case body 2.

The case body 2 is equipped with a finger reception section 31 provided approximately in the center of a front surface of the case body 2, into which a finger (hereinafter referred to as "a print finger U1") corresponding to a nail T as a drawing object is inserted.

Below the finger reception section 31, a finger retraction section 32 is provided, into which fingers (hereinafter referred to as "non-print fingers") corresponding to nails T which are not drawing objects (i.e. print-waiting nails T and/or already-printed nails T) are inserted.

In the vicinity of one side surface (left side surface in FIG. 1) of the case body 2, a pen replacement lid 23 is provided. The pen replacement lid 23 can be opened and closed so as to enable replacement of a pen 48 of a later-described printing section 40, and occludes a pen replacement port in the closed status.

The pen replacement lid 23 is rotatable around, for example, a hinge or the like, between the opened status and the closed status as described in FIG. 1.

A pen replacement hole 121 is provided in the vicinity of one end of a later-described upper machine casing 12 and at a position corresponding to the pen replacement lid 23. The pen replacement port and the pen replacement hole 121 are preferably connected to each other with a not-illustrated cylindrical member extending to above the pen 48. According to such a configuration, the pen 48 can be prevented from touching periphery components of the apparatus when the pen 48 is put in and out through the cylindrical member, and thereby replacement of the pen 48 can be smoothly performed.

A medium discharging port 24 (see FIG. 2) is formed in a back surface of the case body 2 and at a position corresponding to a later-described pen test writing unit 65. A drawing object medium 66 which has, for example, a long and roll shape and is disposed on the pen test writing unit 65 can be discharged from the medium discharging port 24.

An operation section 25 (see FIG. 3) is disposed on an upper surface (top plate) of the case body 2.

The operation section 25 functions as an input section in which a user performs various inputting operations.

Various operation buttons for performing various inputting operations are arranged in the operation section 25. The operation buttons include, for example, a power switch button for turning ON a power source of the drawing apparatus 1, a stop switch button for stopping the operations, a design selection button for selecting a design image to be printed on the nail T, and a print start button for instructing to start printing.

A display section 26 is disposed approximately in the center of the upper surface (top plate) of the case body 2.

The display section 26 is composed of, for example, a Liquid Crystal Display (LCD), organic electroluminescence display, other flat displays or the like. In this embodiment, the display section 26 appropriately displays, for example, an image (hereinafter referred to as "a finger image") obtained by imaging the print finger U1, a nail image (an image of a contour line or the like of the nail T) contained in the finger image, a design selection screen for selecting the design image to be printed on the nail T, a thumbnail image for confirming the design, and an instruction screen on which various instructions are displayed.

Incidentally, a touch panel can be integrally formed with the surface of the display section 26. In this case, the display section 26 is configured so that various inputting operations can be performed by touch operations, namely, touching the surface of the display section 26 with a fingertip, stylus pen, pointed styloid writing implement, or the like.

The case body 2 houses an apparatus body 10 of the drawing apparatus 1.

The apparatus body 10 has approximately a box shape. The apparatus body 10 includes a lower machine casing 11 disposed in a lower space in the inside of the case body 2, and the upper machine casing 12 disposed above the lower machine casing 11 and in an upper space in the inside of the case body 2. In the lower machine casing and the upper machine casing 12, a finger fixing section 30, a printing section 40, an imaging section 50, a print maintenance section 60, the pen test writing unit 65, a cartridge mounting section 70, and a control device 80 (see FIG. 3) are provided.

First, the lower machine casing 11 will be described.

The lower machine casing 11 is equipped with a back plate 111, a base plate 112, a pair of right and left side plates 113, 114, a cartridge housing section 115, and a partition 116.

The bottom ends of the side plates 113, 114 are attached to the right and left ends of the base plate 112 so that the side plates 113, 114 are in upright positions with respect to the base plate 112.

The back plate 111 is attached to the back ends of the base plate 112 and side plates 113, 114 so as to close the space enclosed by the base plate 112 and side plates 113, 114 from back side.

The back plate 111 is bent in the midway so that the lower portion of the back plate 11 is located forward than the upper portion of the back plate 11, and the space formed behind the lower portion of the back plate becomes the cartridge housing section 115. The cartridge mounting section 70, in which ink cartridges 71 are mounted, is disposed in the cartridge housing section 115.

The partition 116 is provided in the inside of the lower machine casing 11 so as to divide the space (space enclosed by the back plate 11, base plate 112 and side plates 113, 114) inside the lower machine casing 11 into upper and lower spaces. The partition 116 is provided substantially parallel to the base plate 112. The right and left ends of the partition 116 are attached to the side plates 113, 114, respectively, and the back end of the partition 116 is attached to the back plate 111.

The finger fixing section 30 is formed integrally with the lower machine casing 11.

The finger fixing section 30 includes the finger reception section 31 to receive the print finger U1 corresponding to the nail T on which printing is to be performed, and the finger retraction section 32 to receive the non-print fingers which are not the print finger U1.

The finger reception section 31 is disposed above the partition 116 and approximately in the middle of the width of the lower machine casing 11.

The finger retraction section 32 is composed of the lower space of the lower machine casing 11 divided by the partition 116.

The finger reception section 31 is opened at the foreside (near side) and the upper side of the lower machine casing 11. The lower side of the finger reception section 31 composes a print finger placing section 116A which constitutes a part of the partition 116.

Front walls 31F are provided to stand at both side portions on the front face side of the lower machine casing 11, on the upper surface of the partition 116, so that the front walls 31F cover the front face of the lower machine casing 11.

On the upper surface of the partition 116, a pair of guide walls 31G is provided to stand. The distance between the guide walls 31G becomes narrow toward the finger reception section 31 from both ends of the front walls 31F, the ends being near the center of the front face of the lower machine casing 11, so as to guide the print finger U1 into the finger reception section 31.

A user can hold the partition 116 between the print finger U1 inserted into the finger reception section 31 and the non-print fingers inserted into the finger retraction section 32. According to this configuration, the print finger U1 inserted into the finger reception section 31 can be stably fixed.

Incidentally, in this embodiment, a protruding section 116B is formed in the front end portion of the partition 116 so as to protrude downward. The protruding section 116B may be a tapered portion whose thickness gradually decreases toward the near side and gradually increases toward the deeper side. Alternatively, the protruding section 116B may wholly have a larger thickness than that of a recessed portion at the deeper position of the partition 116. Because the protruding section 116B is disposed at front end portion of the partition 116, a space can be ensured between the nail(s) T of the already-printed finger(s) and the partition 116 when the non-print finger(s) is inserted into the finger retraction section 32. According to this configuration, the nail(s) T can be prevented from touching the lower surface of the partition 116, and thereby an ink can be prevented from adhering to the apparatus and the pattern printed on the nail(s) can be prevented from being rubbed and/or impaired.

The print maintenance section 60 which keeps print heads 46 in a printable condition is disposed on one side (a right side in FIG. 1) of the finger reception section 31 on the upper surface of the partition 116.

The print maintenance section 60 is preferably disposed at the approximately same height as that of the nail T at the time when the print finger U1 is inserted into the finger reception section 31.

The print maintenance section 60 is located within a movable range of the print heads 46 and the pen 48 moved by a head driving section 47 in the planar view.

The print maintenance section 60 is composed of, for example, a head cleaning cap mechanism 61 or an ink disposing section 62, or both of the head cleaning cap mechanism 61 and ink disposing section 62.

The head cleaning cap mechanism 61 performs cleaning of the print heads 46, and/or covers the print heads 46 with a cap(s) so as to maintain the print heads in moisturizing statuses. Moreover, in this embodiment, the head cleaning cap mechanism 61 includes a pen cap to be put on a nib 482 of the pen 48 when drawing is not performed. By housing the nib 482 inside the pen cap at the time of non-drawing, the nib 482 can be prevented from being dried at the time of non-drawing, and can be maintained in a drawable condition.

The ink disposing section 62 receives extra ink ejected from the print heads 46 so as to keep nozzles of the print heads 46 in optimum statuses. Incidentally, though the head cleaning cap mechanism 61 is described herein, a head cleaning mechanism and a cap mechanism can be provided independently from each other.

The pen test writing unit 65 for after-mentioned test writing of the pen 48 is disposed within a range in which the pen 48 can execute drawing, on the other side (at a position corresponding to the medium discharging port 24 of the case body 2; on the left side in FIG. 1) of the finger reception section 31 on the upper surface of the partition 116. The pen test writing unit 65 is preferably provided at the approximately same height as that of the nail T at the time when the print finger U1 is inserted into the finger reception section 31.

On the nearer side (the right side in FIG. 2) than the pen test writing unit 65 in the apparatus, the long drawing object medium 66 wound in a roll shape is placed. The drawing object medium 66 is fed to the pen test writing unit 65 by a not-illustrated medium feeding mechanism at proper timing, for example, by every one scale unit. The medium feeding mechanism can automatically feed the drawing object medium 66, or manually feed the drawing object medium 66.

The pen test writing unit 65 is a flat plate portion. One end of the pen test writing unit 65 on the near side in the apparatus is contact with the drawing object medium 66, and the other end on the deeper side in the apparatus is located in the vicinity of the medium discharging port 24. The drawing object medium 66 fed by the medium feeding mechanism is placed on the pen test writing unit 65. The drawing object medium 66 is sequentially discharged, from one side thereof, from the medium discharging port 24 to be outside of the apparatus so that the drawing object medium 66 can be disposed.

Any drawing object medium 66 placed on the pen test writing unit 65 can be used as long as it can condition the nib 482. For example, rolled paper can be used.

In the pen test writing unit 65, the pen 48 is brought down on the drawing object medium 66 before the drawing on the nail T is started based on the image data, and trial writing is performed by drawing a predetermined figure such as "circle (○)" and "infinity (∞)", to bring the nib 482 into a good condition, in order to prevent drawn lines from being patchy, at the beginning of drawing, when the nib 482 is dry and/or when the medium does not take ink well. The predetermined figure drawn in the trial writing is not particularly limited, but preferably a simple figure such as "circle (○)" and "infinity) (∞)" in order to prevent the ink from being wasted.

The trial writing is performed by drawing the figure such as "circle (○)" and "infinity) (∞)" while shifting the drawing position little by little each time the trial writing is performed.

Incidentally, when the entire surface of the portion of the drawing object medium 66, the portion being placed on the pen test writing unit 65, is substantially filled with the figures, the medium feeding mechanism feeds the drawing object medium 66 toward the medium discharging port 24 approximately by every one scale unit so that a new portion of the drawing object medium 66 is placed on the pen test writing unit 65. Accordingly, the trial writing can be performed well again. In the case of manually feeding the drawing object medium 66, the display section 26 preferably displays a display screen including a message for suggesting pulling out the drawing object medium 66, e.g. "Pull out the roll paper.", when it becomes necessary to place the new portion of the drawing object medium 66 on the pen test writing unit 65.

A replacement port for the drawing object medium 66 is provided in the side surface of the case body 2 though not illustrated, and new drawing object medium 66 can be loaded via the replacement port when all the roll drawing object medium 66 is used up. In this case, the roll drawing object medium 66 is slightly pulled out to be set so that it is placed on the pen test writing unit 65 and the end portion (approximately corresponding to one scale) of the roll drawing object medium 66 extends outside from the medium discharging port 24.

The printing section 40 includes guide rods 41, a main carriage 42, guide rods 44, a sub carriage 45, the print heads 46, the head driving section 47 and the ink cartridges 71, which are mainly provided in the upper machine casing 12.

Concretely, as illustrated in FIGS. 1 and 2, two guide rods 41 are disposed parallel to each other between both side plates of the upper machine casing 12. The main carriage 42 is slidably disposed on the guide rods 41.

As illustrated in FIG. 2, two guide rods 44 are disposed parallel to each other between a front wall 42A and a back wall 42B of the main carriage 42. The sub carriage 45 is slidably disposed on the guide rods 44. The print heads 46 are mounted in the central portion of the lower surface of the sub carriage 45.

In this embodiment, the print heads 46 are ink-jet type print heads which perform printing by making minute ink droplets and directly spraying the ink droplets onto a printing object surface (a drawing object surface) of a drawing object. Incidentally, the recording system of the print heads 46 is not limited to the inkjet system.

In this embodiment, the print heads 46 of the printing section 40 print the image (the design image, etc.) on the surface of the nail T of the print finger U1, as the surface of the drawing object, on the basis of print data.

The printing section 40 of this embodiment includes the print heads 46 which correspond to inks of, for example, Yellow (Y), Magenta (M), and Cyan (C).

Each of the print heads 46 includes a nozzle array composed of a plurality of nozzles ejecting the ink of each of the colors. The print heads 46 are not limited to those ejecting the inks of the above three colors. Also additional print head(s) 46 ejecting ink(s) of other color(s) can be provided.

The cartridge mounting section 70 disposed in the cartridge housing section 115 includes the ink cartridges 71 corresponding to the inks ejected from the print heads 46, respectively. The inks stored in the ink cartridges 71 are supplied to the print heads 46, respectively, at proper timings, through the cartridge mounting section 70, not-illustrated ink supply tubes, etc. Alternatively, the ink cartridges 71 may be mounted on the print heads 46 themselves.

The print head 46 of this embodiment is movable in X direction, namely, the width direction (crosswise direction) of the drawing apparatus 1, and in Y direction, namely, the depth direction (front-back direction) of the drawing apparatus 1, by the head driving section 47 composed of a main scanning motor 47A, a sub scanning motor 47B, and so on.

The main carriage 42 is connected to the main scanning motor 47A via a power transmission section (not illustrated), and moves along the crosswise direction along the guide rods 41 by reciprocal rotation of the main scanning motor 47A.

The sub carriage 45 is connected to the sub scanning motor 47B via a power transmission section (not illustrated), and moves along the front-back direction along the guide rods 44 by reciprocal rotation of the sub scanning motor 47B.

In this embodiment, a pen holder (drawing tool holder) 49 holding the pen (drawing tool) 48 is disposed in the sub carriage 45 which supports the print heads 46. The pen 48 functions as a base coat forming section which forms a base coat region on the nail T of the print finger U1.

As illustrated in FIG. 2, the pen holder 49 is located to the side of the main carriage 42, and one end of the pen holder 49 is fixed to the underside of the sub carriage 45.

Because the pen holder 49 of this embodiment is fixed to the sub carriage 45, the head driving section 47 of the printing section 40 moves the print heads 46 and the pen 48 together while holding the print heads 46 and the pen 48 at equal distances from each other.

Because the pen holder 49 fixed to the sub carriage 45 moves in accordance with the movement of the print heads 46 supported by the sub carriage 45, the head driving section 47 simultaneously moves the print heads 46 and the pen 48 together.

Incidentally, the position at which the pen holder 49 is attached to the sub carriage 45 is not limited to the illustrated example.

The pen 48 held by the pen holder 49 includes the nib 482 at the tip of a pen shaft portion 481.

The inner part of the pen shaft portion 481 composes an ink storage section which stores various inks. The viscosity and/or particle diameter (particle size) of coloring material of the inks stored in the inner part of the pen shaft portion 481 are not particularly limited. However, in this embodiment, the pen 48 has the configuration to draw the base coat, and the inks housed in the inner part of the pen shaft portion 481 of the pen 48 used for drawing of the base coat are preferably non-transmissive, and usable as the base coat.

Herein, the ink usable as the base coat is preferably an ink having a color which does not damage the color development of the patterns and the like printed on the base coat color by the inkjet type print heads. Specifically, the ink preferably has a light color such as white, pale gray and silver. Moreover, the ink usable as the base coat preferably has an accepting function to accept the ink ejected by the inkjet type print heads.

The pen 48 as the drawing tool has the nib 482 of a ballpoint pen type by which the inks stored in the pen shaft portion 481 oozes out to be used for drawing, for example, when the nib 482 is pressed against the surface of the nail T. The type of the pen 48 is not limited to the ballpoint pen type, and may be a felt-tip pen type which uses an ink-soaked felt nib for drawing, or a calligraphy-brush pen type which uses an ink-soaked bundled fibers for drawing. The nib 482 may have any kinds of size/thickness.

The pen 48 is held by the pen holder 49 by merely being inserted into the pen holder 49 from above, and can be easily taken out and replaced, for example, by opening the pen replacement lid 23 of the case body 2 and taking the pen 48 with a hand (fingers) or a pair of tweezers. According to this configuration, a user can appropriately replace the pen 48 held by the pen holder 49 with another pen 48 having a different kind of nib 482 and/or ink depending on the design image to be drawn, and accordingly a wide range of design images can be implemented.

The pen holder 49 as the drawing tool holder moves the pen 48 in a vertical direction by cooperation between a spring 493 and a solenoid 495 (see FIG. 2), while holding the pen 48 substantially vertically.

Specifically, the pen 48 is brought down against a biasing force of the spring 493, while the solenoid 495 is being driven, to reach a drawable condition in which the pen 48 can touch the surface of the nail T and/or the drawing object medium 66.

In the state that the solenoid 495 is released, the pen 48 moves upward by the biasing force of the spring 493 to reach a non-drawing condition in which the pen does not touch the surface of the nail T or the drawing object medium 66.

The imaging section 50 is disposed in the upper machine casing 12.

A substrate 13 is placed on the upper machine casing 12, and a camera 51 is installed in the center of the undersurface of the substrate 13. The camera 51 preferably has a resolution of, for example, approximately two million pixels or more.

The camera 51 is an imaging device which captures the image of the nail T (the print finger U1 including the nail T) of the print finger U1 inserted into the finger reception section 31.

A plurality of illuminating lamps (illuminating devices) 52 such as white LEDs are installed on the substrate 13 so as to surround the camera 51. The illuminating lumps 52 illuminate the nail T of the print finger U1 with light when the camera 51 performs imaging. Thus, the imaging section 50 is composed of the camera 1 and the illumination lamps 52.

In this embodiment, a later-described nail information detecting section 812 (see FIG. 3) detects nail information such as the shape, position (including positions in horizontal and height directions) and curvature of the nail T, based on the image (the finger image including the nail image) of the nail T of the print finger U1 obtained by the camera 51 as the imaging device.

The imaging section 50 is connected to a later-described imaging control section 811 (see FIG. 3) of the control device 80, and controlled by the imaging control section 811.

The image data of the images captured by the imaging section 50 are stored in a later-described nail image storage region 821 of a storage section 82.

The control device 80 is disposed, for example, on the substrate 13 placed on the upper machine casing 12.

Figure 3:
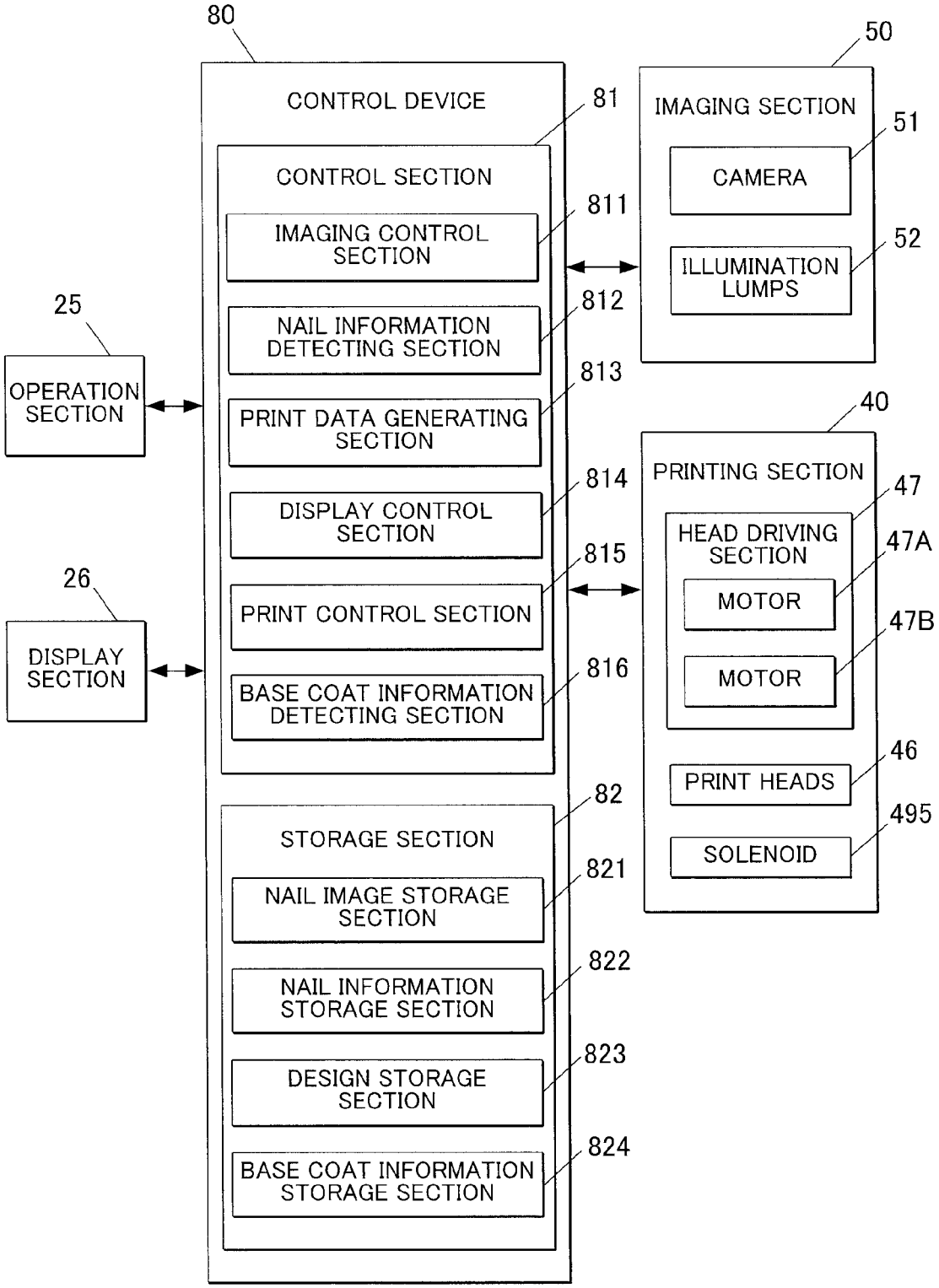
FIG. 3 is a block diagram of principal parts illustrating a control configuration according to this embodiment.

FIG. 3 is a block diagram of principal parts illustrating the control configuration according to this embodiment.

As illustrated in FIG. 3, the control device 80 is a computer which includes a control section 81 composed of a Central Processing Unit (CPU), and the storage section 82 composed of a Read Only Memory (ROM), Random Access Memory (RAM), etc.

The storage section 82 stores various programs for operating the drawing apparatus 1, various pieces of data, and so on.

Specifically, the ROM of the storage section 82 stores various programs including: a nail information detecting program for detecting the nail information such as the shape, position and curvature of the nail T from the nail image; a print data generating program for generating the print data; and a printing program for executing a printing process. The sections of the drawing apparatus 1 are collectively controlled by execution of these programs by the control device 80.

The storage section 82 of this embodiment includes; the nail image storage region 821 in which the nail image of the nail T of the print finger U1 of a user, obtained by the imaging section 50, is stored; a nail information storage region 822 in which the nail information detected by the nail information detecting section 812 is stored; a design storage region 823 in which the image data of the design image to be printed on the nail T is stored; and a base coat information storage region 824 in which base coat information detected by a base coat information detecting section 816 is stored.

The control section 81 functionally includes the imaging control section 811, the nail information detecting section 812, a print data generating section 813, a display control section 814, a print control section 815, and the base coat information detecting section 816. The functions as the imaging control section 811, the nail information detecting section 812, the print data generating section 813, the display control section 814, the print control section 815, and the base coat information detecting section 816 are implemented by cooperation between the CPU of the control section 81 and the programs stored in the ROM of the storage section 82.

The imaging control section 811 controls the camera 51 and the illumination lamps 52 of the imaging section 50 so that the camera 51 captures the image of the nail T of the print finger U1 inserted into the finger reception section 31.

In this embodiment, the imaging control section 811 controls the camera 51 and the illumination lamps 52 of the imaging section 50 to perform imaging of the nail T of the print finger U1 to obtain the image of the nail T.

The nail information detecting section 812 detects the nail information of the nail T of the print finger U1 based on the image of the nail T of the print finger U1, the image being captured by the camera 51.

Herein, the nail information is information as to the contour (a nail shape and a horizontal position) of the nail T, the height (a position of the nail T in the vertical direction, hereinafter referred to as "a vertical position of the nail T" or merely referred to as "a position of the nail T") of the nail T, and the curvature (nail curvature) of the nail T. The nail information detecting section 812 detects at least any one of the shape, position, and curvature of the nail T as the nail information. In this embodiment, the nail information detecting section 812 detects all of the shape, position, and curvature of the nail T based on the nail image.

Specifically, the nail information detecting section 812 detects the contour (shape/size) and position of the nail T from the finger image including the nail image of the nail T of the print finger U1, the image being obtained by the camera 51, to obtain the contour/position as information represented by x-y coordinates or the like. The nail information detecting section 812 detects the contour (shape) of the nail T, for example, on the basis of a difference between colors of the nail T and other finger portions, from the finger image including the nail image of the nail T of the print finger U1 obtained by the camera 51. Incidentally, the method for detecting the contour (shape) of the nail T by the nail information detecting section 812 is not particularly limited to the illustrated example.

Moreover, the nail information detecting section 812 detects the nail height of the nail T based on the image of the nail T captured by the camera 51. The nail height means the position of the nail T in the vertical direction.

Furthermore, the nail information detecting section 812 detects the nail curvature of the nail T based on the image of the nail T captured by the camera 51. The nail curvature means the curvature in the width direction of the nail T.

The nail information detecting section 812 can estimate the nail height and/or nail curvature of the nail T, for example, from a shade change and the like occurring in the nail image, by imaging the nail T from two different angles by the camera 51.

Incidentally, the method for detecting the nail height and/or nail curvature of the nail T by the nail information detecting section 812 is not particularly limited to the above examples.

The print data generating section 813 generates the data used for printing executed on the nail T of the print finger U1 by the print heads 46, on the basis of the nail information detected by the nail information detecting section 812.

Specifically, the print data generating section 813 performs a fitting process, for example, by reducing the image data of the design image on the basis of the nail information as to the shape of the nail T, etc. detected by the nail information detecting section 812, to generate the data used for printing of the image design executed on the nail T.

The print data generating section 813 also generates base coat data based on the generated data for printing. The base coat data is used for producing the base coat region of the image (image design) based on the data for printing. The base coat data is produced so as to have a size and shape corresponding to the contour of the image design.

The display control section 814 controls the display section 26 to display various kinds of display screens. In this embodiment, the display control section 814 causes the display section 26 to display the selection screen for selecting the design image, the thumbnail image for confirming the design, the finger image obtained by imaging the print finger U1, the nail image contained in the finger image, various kinds of instruction screens, and so on.

The print control section 815 controls the print data generating section 813 to output the generated print data to the printing section 40, and controls the operations of the main scanning motor 47A and the sub scanning motor 47B of the head driving section 47, the print heads 46, and the solenoid 495 which vertically moves the pen 48, of the printing section 40, so as to perform the printing onto the nail T according to the print data.

The base coat information detecting section 816 detects the base coat information as to the base coat region based on the image obtained by imaging the nail T of the print finger U1, on which the base coat is drawn, by the camera 51.

Herein, the base coat information means the contour (shape) of the base coat region.

Specifically, the base coat information detecting section 816 detects the contour and position of the base coat region from the finger image of the print finger U1 obtained by the camera 51 to acquire the contour/position as the information represented by x-y coordinates or the like. The base coat information detecting section 816 detects the contour of the base coat region, for example, based on the difference between the colors of the base coat region and other nail portions obtained from the finger image captured by the camera 51.

Next, the operations of the drawing apparatus 1 and the drawing control method according to this embodiment will be described.

Figure 4:
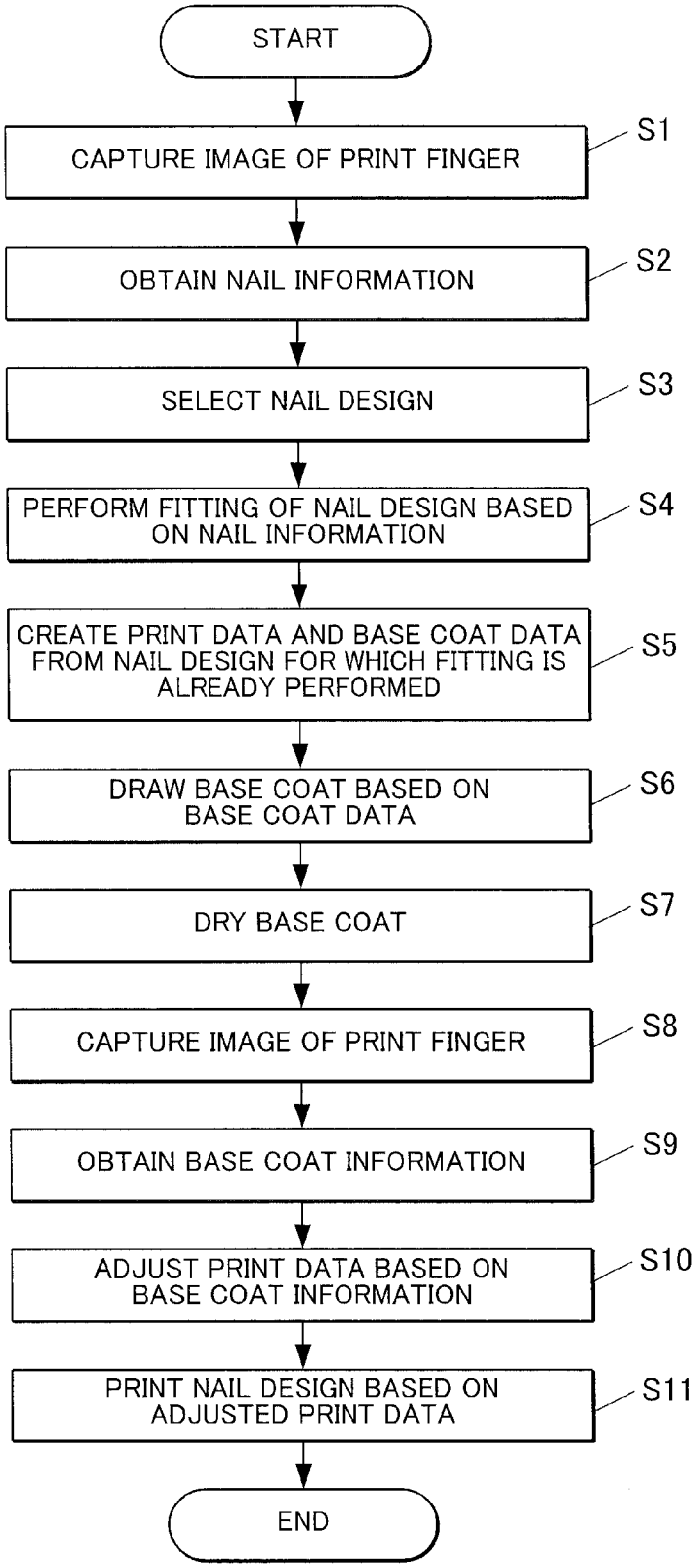
FIG. 4 is a flowchart illustrating a flow of a drawing control method according to this embodiment.

FIG. 4 is a flowchart illustrating the flow of the drawing control method.

When executing the printing by the drawing apparatus 1, a user firstly turns on the power switch to activate the control device 80.

Next, a user inserts the print finger U1 into the finger reception section 31, inserts the non-print fingers into the finger retraction section 32, and operates a print switch while the print finger U1 is fixed.

When the print switch receives the input of the instruction, before the printing operation is started, the imaging control section 811 controls the imaging section 50 so that the camera 51 images the print finger U1 while illumination lumps 52 throw light over the print finger U1. Thus, the imaging control section 811 obtains the image of the nail T of the print finger U1 inserted into the finger reception section 31 (Step S1).

Then, the nail information detecting section 812 detects (calculates) the contour (shape/size), position (including the vertical position), and curvature of the nail T on the basis of the image of the nail T to obtain the nail information (Step S2).

After that, the display control section 814 causes the display section 26 to display the design selection screen. A user operates the operation section 25 to select an intended design image from among the plural design images displayed on the design selection screen, and thereby a selection instruction signal is output from the operation section 25 and the design image to be printed on the nail T is selected (Step S3).

When the nail information detecting section 812 detects the shape, position and curvature of the nail T, the print data generating section 813 performs the fitting process of the image data of the design image to the nail T on the basis of the nail information (Step S4).

The print data generating section 813 also performs a curved surface correction to the image data of the design image on the basis of the nail information. Thus, the data for printing is generated.

The print data generating section 813 further generates the base coat data having the size and shape corresponding to the contour of the image design on the basis of the data for printing (Step S5).

Figure 5A:
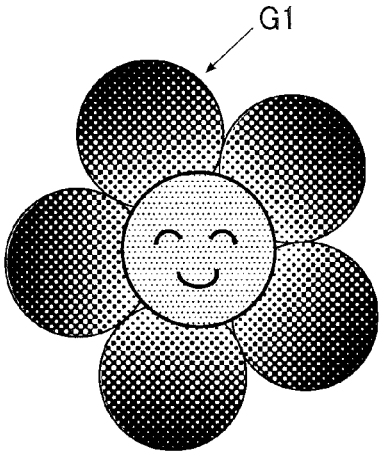
FIGS. 5A and 5B are explanatory diagrams each illustrating an example design image.
Figure 5B:
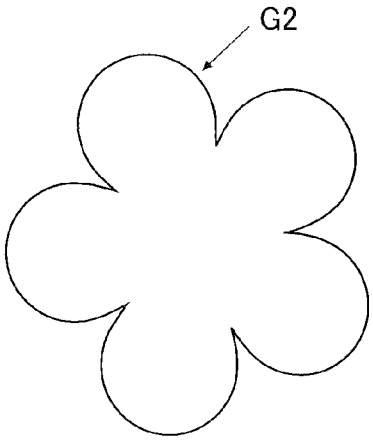

FIGS. 5A and 5B are explanatory drawings illustrating example design images. FIG. 5A illustrates the image design based on the data for printing, and FIG. 5B illustrates the shape of the base coat region based on the base coat data.

As illustrated in FIG. 5A, the image design G1 based on the data for printing is a flowery character. The base coat data is generated so as to have the shape corresponding to the contour of the image design G1, and the base coat G2 based on the base coat data becomes an object which is obtained by filling in an inner area of the contour of the image design G1.

Next, the print control section 815 outputs the base coat data to the printing section 40, and drives the solenoid 495 of the pen holder 49 at proper timings so that the base coat G2 based on the base coat data is drawn on the nail T (Step S6).

Concretely, the print control section 815 drives the solenoid 495 of the pen holder 49 so that the pen 48 is brought into the drawable status, and controls the head driving section 47 to operate based on the base coat data so that the pen holder 49 moves in X and Y directions at proper timings to perform drawing on the nail T.

At that time, the pen 48 is pressed against the surface of the nail T by its own weight, and performs drawing while following the surface shape of the nail T by vertical movement.

Figure 6A:
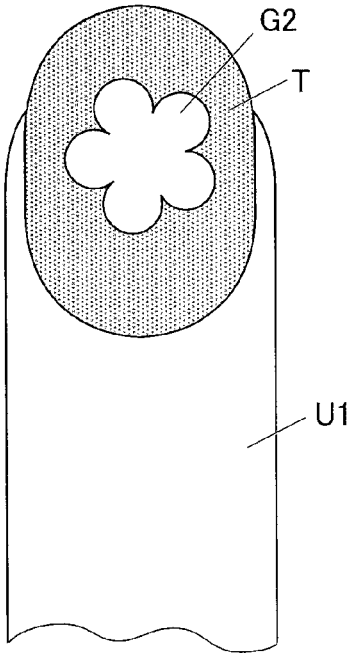
FIGS. 6A and 6B are explanatory diagrams each illustrating a status of a nail at the time of printing.
Figure 6B:
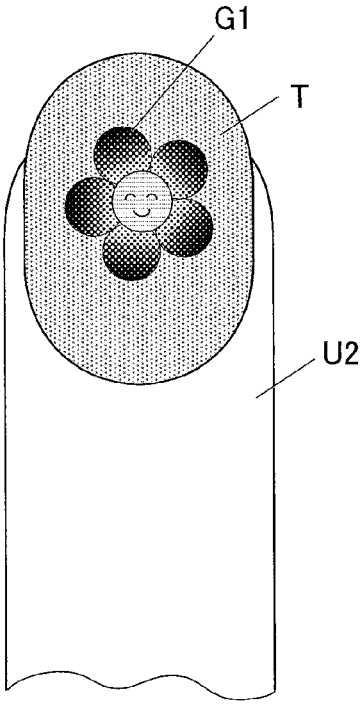

FIGS. 6A and 6B are explanatory drawings illustrating the statuses of the nail T at the time of printing. FIG. 6A illustrates the status of the nail T on which the base coat G2 is drawn, and FIG. 6B illustrates the status of the nail T on which the image design G1 is drawn.

In Step S6, the base coat G2 is drawn on the nail T as illustrated in FIG. 6A.

Incidentally, the print control section 815 makes the pen 48 move to the pen test writing unit 65 before starting the printing onto the nail T, and drives the solenoid 495 of the pen holder 49 holding the pen 48 so that the pen 48 is brought into the drawable status. Then, the trial writing is performed by drawing a predetermined figure such as "circle (○)" and "infinity (∞)" on the drawing object medium 66.

Then, the print control section 815 temporarily stops the printing operation until a predetermined time elapses, during which time the base coat G2 dries (Step S7).

Incidentally, though the base coat G2 is dried by merely waiting the lapse of the predetermined time in this embodiment, it is also possible to provide, for example, a drying means such as a fan, and to drive the drying means to accelerate the drying of the base coat G2.

Furthermore, for example, in the case of using an ultraviolet ray curable ink for the base coat G2, a UV light source can be used as the drying means.

After that, the imaging control section 811 controls the imaging section 50 so that the camera 51 images the print finger U1 while the illumination lamps 52 throw light over the print finger U1.

Thus, the imaging control section 811 obtains the image of the nail T on which the base coat G2 is drawn (Step S8).

Next, the base coat information detecting section 816 detects (calculates) the contour of the region (base coat region) of the drawn figure of the base coat G2, on the basis of the image of the nail T obtained in Step S8, to acquire the base coat information (Step S9).

After that, the print data generating section 813 adjusts the size of the image design G1 on the basis of the base coat information so that the image design G1 corresponds to the contour of the base coat G2 or becomes larger than the contour of the base coat G2 by a preset amount which is previously set, to generate the adjusted design image, and then generates the data for printing based on the adjusted design image (Step S10).

Thus, the print data generating section 813 functions as a design adjusting section of the present invention.

Herein, the preset amount is preferably about several ten micrometer to several hundred micrometer. Specifically, the preset amount is preferably within the range from about 10 μm to about 500 μm. The value of the preset amount may be a preset fixed value, or may be an optimum value depending on the ink used in the pen 48 and/or the kind of the pen 48.

Next, the print control section 815 outputs the data for printing to the printing section 40, and drives the print heads 46 at proper timings so that the image design G1 based on the data for printing is printed on the nail T (Step S11). In Step S11, the image design G1 is drawn on the base coat G2 as illustrated in FIG. 6B.

Herein the effects of this embodiment are described.

Figure 7:
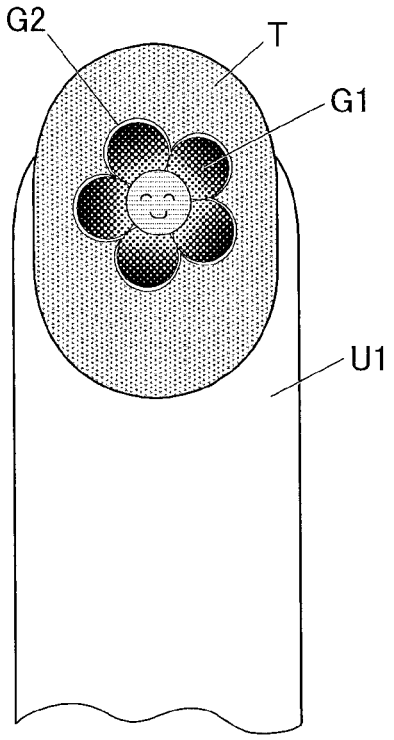
FIG. 7 is an explanatory diagram for explaining a problem when printing is performed without adjustment of a size of an image design.

FIG. 7 is an explanatory diagram for explaining a problem when the image design G1 is printed on the base coat G2 without size adjustment.

In this case, the contour of the region (base coat region) of the base coat G2 drawn with the pen 48 based on the base coat data is controlled to correspond to the contour of the image design G1. However, in actual fact, sometimes the contour of the base coat region becomes slightly larger than the shape corresponding to the contour of the image design G1, the shape being specified in the base coat data, though it is similar to the shape of the contour of the image design G1, because the nib 482 of the pen 48 has some thickness and/or because of a blur of the pen 48 in the pen holder 49.

For this reason, in the case that the contour of the base coat G2 has a portion(s) protruding from the size specified in the base coat data, when the image design G1 is drawn on the base coat G2 without size adjustment, a part of the base coat G2, namely, an extra portion of the contour of the base coat G2 with respect to the size specified in the base coat data, slightly extends outside the contour of the image design G1.

The ink for the base coat has the light color such as white and pale gray, which is usually different from the base coat color of the nail T or the color of the image design G1. For this reason, when the base coat has the portion extending outside of the contour of the image design G1, even though it is a little, such a portion becomes noticeable, resulting in an uncomfortable feeling.

Figure 8:
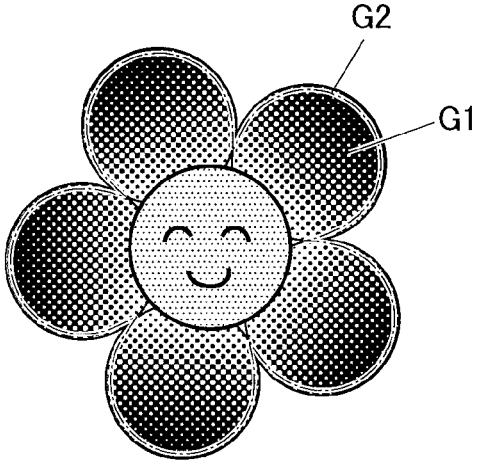
FIG. 8 is an explanatory diagram illustrating an enlarged image design printed on the nail according to this embodiment.

FIG. 8 is an explanatory diagram illustrating the enlarged image design G1 printed on the nail T when the image design G1 is printed on the base coat G2 after size adjustment to make the image design G1 larger than the contour of the base coat G2, according to this embodiment.

In FIG. 8, an external form of the base coat G2 is indicated by a chain line.

As illustrated in FIG. 8, because the image design G1 is printed so as to be larger than the base coat G2, the base coat G2 is entirely covered with the image design G1, in this embodiment. By this, the base coat G2 does not extend outside of the contour of the image design G1, which prevent the uncomfortable feeling due to protrusion of the base coat G2 from the contour of the image design G1.

Although a part of the image design G1 in the vicinity of the contour thereof protrudes outside of the contour of the base coat G2, the base coat color of the nail T is seen through this part, and accordingly uncomfortable feeling hardly occurs.

Incidentally, the case of the size adjustment to make the image design G1 larger than the contour of the base coat G2 is described with reference to FIG. 8. However, the size adjustment can be performed so that the image design G1 corresponds to the contour of the base coat G2. Also in this case, the base coat G2 can be prevented from extending from the image design G1.

However, the ink for the base coat has relatively large particles, and relatively high viscosity, and accordingly the thickness of the base coat G2 becomes relatively large. For this reason, when the contour of the image design G1 and the contour of the base coat G2 correspond to each other, sometimes the side of the base coat G2 can be seen from an oblique or lateral direction, though the base coat G2 is not seen from above.

For this reason, the size of the image design G1 is preferably adjusted so as to be larger than the contour of the base coat G2.

When the printing is completed, the print control section 815 moves the print heads 46 above the print maintenance section 60, and puts the caps on the print heads 46 and the pen 48 so that the print heads 46 and the pen 48 are prevented from being dried.

As described above, according to the drawing apparatus 1 of this embodiment, because the image design G1 is printed on the base coat G2, the color development of the image design G1 is improved by the base coat G2 even when the image design G1 is printed by the inkjet system. Therefore, even when the image design G1 is printed by the inkjet system, the color development of the inks becomes good and accordingly design characteristics of the image design G1 are improved.

Moreover, because the image design G1 is formed so as to correspond to the contour of the base coat G2, or become larger than the contour of the base coat G2 at least by the preset amount, in this embodiment, the base coat G2 can be prevented from extending from the image design G1 and being noticeable.

Furthermore, by detecting the external form of the base coat G2 formed on the nail T and adjusting the image design G1 so that the image design G1 corresponds to the detected contour of the base coat G2 or becomes larger than the detected contour at least by the preset amount, the image design G1 can surely cover the whole area of the actually-formed base coat G2.

Moreover, because the pen 48 which touches the surface of the nail T as the drawing object and executes the drawing thereon is the base coat forming section of the present invention, the base coat G2 can be more effectively formed than the case of forming the base coat G2 by the print heads 46. Especially, though there is a possibility that the print heads 46 cannot eject the inks suitable for forming the base coat G2, the pen 48 can stably form the base coat G2.

Incidentally, in the case the print heads 46 can stably form the base coat G2, it is possible to cause the print heads 46 to form the base coat G2.

Incidentally, embodiments to which the present invention can be applied are not limited to the above, and can be appropriately changed without departing from the spirit of the present invention.

For example, though the inks having the accepting function are illustrated as the inks usable for the base coat G2, also the inks not having the accepting function can be used for the base coat G2. In this case, after forming the base coat G2, an accepting liquid is applied on the base coat G2. In this case, the image design is formed on the dried accepting liquid.

Figure 9:
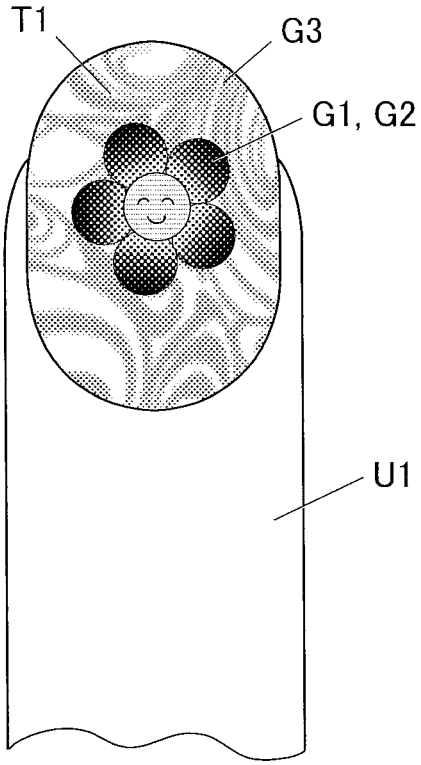
FIG. 9 is an explanatory diagram illustrating another example design image.

Although the case of directly forming the base coat G2 on the nail T is illustrated in this example, it is also possible to previously form a design G3 on the nail T1, then form the base coat G2 on the design G3, and form the image design G1 on the base coat G2, as illustrated in FIG. 9. In such a case, the color of the design G3 can be prevented from affecting on the image deign G1.

In this embodiment, the case that the drawing apparatus 1 is the nail printing apparatus is described. However, the drawing object of the drawing apparatus 1 is not limited to the nail T. The drawing object may be anything except the nail T. The drawing object other than the nail T includes, for example, stationery, items/tools used for hobbies, colored paper, etc.

Although some embodiments of the present invention are described above, the scope of the present invention is not limited to the above embodiments and includes the scope of the invention of the claims and the scope of equivalents thereof.

What is claimed is:

1. A drawing apparatus comprising:

a base coat information detecting section that detects, as base coat information, a contour of a base coat region which is formed on a surface of a drawing object by applying a first ink used for a base coat with a drawing tool so as to fill in a design region surrounded with a contour of a design image, before the design image is printed on the surface of the drawing object;

a design adjusting section that adjusts a size of the design image and generates an adjusted design image which has a size sufficient to cover a whole area of the base coat region, based on the base coat information; and a print head that prints the adjusted design image on the base coat region so as to cover the whole area of the base coat region.

2. The drawing apparatus according to claim 1, wherein the print head prints the adjusted design image with a second ink different from the first ink, and the first ink has an accepting function to accept the second ink.

3. The drawing apparatus according to claim 1, wherein the drawing tool is a pen which touches the surface of the drawing object to apply the first ink onto the surface of the drawing object, and the drawing apparatus further includes:

a base coat forming section that forms the base coat region by applying the first ink with the drawing tool, by moving the drawing tool so that the design region is filled while the drawing tool is in contact with the surface of the drawing object.

4. The drawing apparatus according to claim 1, wherein the base coat region is formed to have a larger size than the design region, and the design adjusting section makes the contour of the adjusted design image have a shape corresponding to the contour of the base coat region detected by the base coat information detecting section.

5. The drawing apparatus according to claim 1, wherein the base coat region is formed to have a larger size than the design region, and the design adjusting section makes the contour of the adjusted design image have a shape which is expanded, at least by a preset amount, outward from the contour of the base coat region detected by the base coat information detecting section.

6. The drawing apparatus according to claim 5, wherein the preset amount is in a range from 10 μm to 500 μm.

7. The drawing apparatus according to claim 5, wherein the preset amount is set based on at least any one of a kind of the first ink and a kind of the drawing tool.

8. The drawing apparatus according to claim 1, wherein the base coat information detecting section detects the base coat information based on an image obtained by imaging the base coat region.

9. The drawing apparatus according to claim 1, wherein the print head performs printing by an inkjet system.

10. The drawing apparatus according to claim 1, wherein the surface of the drawing object is a surface of a finger nail or a surface of a toe nail.

11. A method for controlling drawing in a drawing apparatus, the method comprising:

detecting, as base coat information, a contour of a base coat region which is formed on a surface of a drawing object by applying a first ink used for a base coat with a drawing tool so as to fill in a design region surrounded with a contour of a design image, before the design image is printed on the surface of the drawing object;

adjusting the design image and generating an adjusted design image which has a size sufficient to cover a whole area of the base coat region, based on the detected base coat information; and printing the adjusted design image on the base coat region so as to cover the whole area of the base coat region.

12. The method for controlling the drawing in the drawing apparatus according to claim 11, further comprising:

forming the base coat region by applying the first ink onto the surface of the drawing object with the drawing tool, by moving the drawing tool so that the design region is filled while the drawing tool is in contact with the surface of the drawing object.

13. The method for controlling the drawing in the drawing apparatus according to claim 11, wherein the adjusting step includes generating the adjusted design image by making the contour of the design image have a shape corresponding to the detected contour of the base coat region.

14. The method for controlling the drawing in the drawing apparatus according to claim 11, the adjusting step includes generating the adjusted design image by making the contour of the design image have a shape which is expanded, by a preset amount, outward from the detected contour of the base coat region.

15. The method for controlling the drawing in the drawing apparatus according to claim 11, wherein the detecting step includes detecting the base coat information based on an image obtained by imaging the base coat region.

* * * * *